US010392685B2

(12) United States Patent
Boileau et al.

(10) Patent No.: US 10,392,685 B2
(45) Date of Patent: Aug. 27, 2019

(54) COMPOSITE METAL ALLOY MATERIAL

(71) Applicants: Ford Global Technologies, LLC, Dearborn, MI (US); The Regents of the University of Michigan, Ann Arbor, MI (US)

(72) Inventors: James Maurice Boileau, Novi, MI (US); Timothy J. Potter, Dearborn, MI (US); Paul George Sanders, Houghton, MI (US); Matthew John Zaluzec, Canton, MI (US); Pravansu Sekhar Mohanty, Canton, MI (US); Vikram Varadarrajan, Westland, MI (US)

(73) Assignees: THE REGENTS OF THE UNIVERSITY OF MICHIGAN, Ann Arbor, MI (US); FORD GLOBAL TECHNOLOGIES, LLC, Dearborn, MI (US)

( * ) Notice: Subject to any disclaimer, the term of this patent is extended or adjusted under 35 U.S.C. 154(b) by 239 days.

(21) Appl. No.: 14/068,101

(22) Filed: Oct. 31, 2013

(65) Prior Publication Data

US 2015/0118516 A1 Apr. 30, 2015

(51) Int. Cl.
*C23C 4/08* (2016.01)
*C23C 24/04* (2006.01)

(52) U.S. Cl.
CPC ..... *C23C 4/08* (2013.01); *C23C 24/04* (2013.01); *Y10T 428/12757* (2015.01)

(58) Field of Classification Search
None
See application file for complete search history.

(56) References Cited

U.S. PATENT DOCUMENTS 3,111,405 A 11/1963 Cairns, Jr. et al.
3,193,384 A 7/1965 Richardson
(Continued)

FOREIGN PATENT DOCUMENTS

CN 1948544 A 4/2007
CN 1997765 B 7/2007
(Continued)

OTHER PUBLICATIONS

Davis, Jr. "Handbook of Thermal Spray Technology", (Oct. 30, 2004), ISBN-10: 0871707950.

*Primary Examiner* — Daniel J. Schleis
(74) *Attorney, Agent, or Firm* — Julia Voutryas; Brooks Kushman P.C.

(57) ABSTRACT

An alloy composite material comprising an aluminum alloy layer and a thermal spray alloy layer of 20 to 40% Mn and 47 to 76% Fe by weight in overlaying contact with the aluminum alloy layer. An alloy composite material comprising an aluminum alloy layer or base layer and a thermal spray alloy layer of 20 to 40% Mn and 47 to 76% Fe by weight in overlaying contact with the aluminum alloy layer or base layer. The aluminum alloy layer or base layer and the thermal spray alloy layer have a mechanical compatibility to each other of 20-60 MPa as determined using tests specified by ASTM-C633 test. A process of thermal spraying comprising providing a base layer and a feed stock alloy of 20 to 40% Mn and 47 to 76% Fe and thermally spraying the feed stock alloy onto the base layer to form an alloy composite material.

20 Claims, 5 Drawing Sheets

(56) References Cited

U.S. PATENT DOCUMENTS

| | | | | |
|---|---|---|---|---|
| 4,865,662 | A | 9/1989 | Zimmer et al. | |
| 4,875,933 | A | 10/1989 | Wan | |
| 5,884,388 | A | 3/1999 | Patrick et al. | |
| 6,095,107 | A * | 8/2000 | Kloft et al. | 123/193.2 |
| 6,290,032 | B1 | 9/2001 | Patrick et al. | |
| 8,070,894 | B2 | 12/2011 | Branagan | |
| 2006/0093736 | A1 | 5/2006 | Raybould et al. | |
| 2011/0300016 | A1 | 12/2011 | Heath | |

FOREIGN PATENT DOCUMENTS

| | | | |
|---|---|---|---|
| CN | 101671805 | A | 3/2010 |
| DE | 19733306 | C1 | 5/1999 |

* cited by examiner

COMPOSITE METAL ALLOY MATERIAL

TECHNICAL FIELD

One aspect of the present invention relates to a composite metal alloy, in particular a base layer of a first metal alloy supporting a thermal spray alloy surface layer having, by weight, 20% to 40% manganese and 47% to 76% iron.

BACKGROUND

Weight reduction in automotive components may improve fuel economy as well as reduce emissions. One method of weight reduction involves substituting lightweight material for traditional materials such as steel and cast iron. However, in certain application, these lightweight materials do not have the required wear, friction, corrosion, and/or lubrication properties of the traditional materials. A new metal alloy composition is desired that will have the requisite wear, friction, corrosion, and/or lubrication properties. The use of spray technologies can be used to deposit metallic, ceramic, and polymeric coatings to provide enhanced wear, friction, corrosion, and/or lubrication properties in lightweight applications. However, the current thermal spray alloys all have signification limitations in terms of the physical and mechanical properties they possess. Therefore, a need exists to develop a thermally-sprayable steel-based alloy that can provide the wear, friction, corrosion, and/or lubrication properties of traditional materials in a lightweight substrate material.

SUMMARY

Embodiments of the present invention solve one or more problems of the prior art by providing in at least one embodiment, a composite metal alloy material that is lightweight yet has the requisite wear, friction, corrosion, and/or lubrication properties. The composite metal alloy material includes a base layer of a first metal alloy, and a thermal spray alloy surface layer of, by weight, 20 to 40% manganese and 47% to 76% iron.

In another embodiment, an alloy composite is provided. The alloy composite includes an aluminum alloy layer or base layer. A thermal spray alloy layer of, by weight, 20 to 40% manganese and 47% to 76% iron is in overlaying contact with the aluminum alloy layer or base layer. The aluminum alloy layer or base layer and the thermal spray alloy layer have a mechanical compatibility to each other of 20-60 MPa as determined using tests specified by ASTM C633 test.

In yet another embodiment, a process of thermal spraying is provided. The thermal spray process comprises providing a base layer and a feed stock alloy of 20 to 40% Mn and 47 to 76% Fe. The feed stock alloy is thermally sprayed onto the base layer to form an alloy composite material.

BRIEF DESCRIPTION OF THE DRAWINGS

Exemplary embodiments will become more fully understood from the detailed description and the accompanying drawings, wherein.

DETAILED DESCRIPTION

Figure 1:
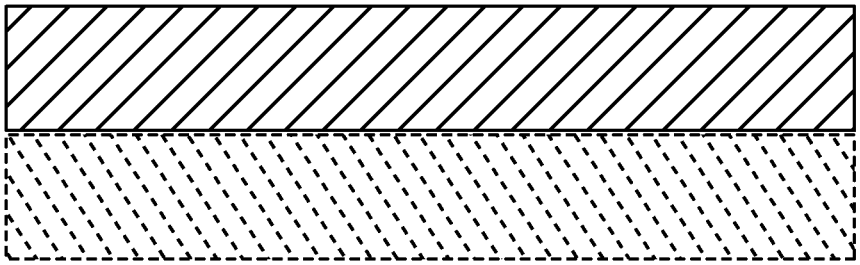
FIG. 1 is a schematic of a base layer and a thermal spray alloy layer overlaying contact with the base layer in at least one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Reference will now be made in detail to presently preferred compositions, embodiments and methods of the present invention, which constitute the best modes of practicing the invention presently known to the inventors. The Figures are not necessarily to scale. However, it is to be understood that the disclosed embodiments are merely exemplary of the invention that may be embodied in various and alternative forms. Therefore, specific details disclosed herein are not to be interpreted as limiting, but merely as a representative basis for any aspect of the invention and/or as a representative basis for teaching one skilled in the art to variously employ the present invention.

It is also to be understood that this invention is not limited to the specific embodiments and methods described below, as specific components and/or conditions may, of course, vary. Furthermore, the terminology used herein is used only for the purpose of describing particular embodiments of the present invention and is not intended to be limiting in any way.

It must also be noted that, as used in the specification and the appended claims, the singular form "a," "an," and "the" comprise plural referents unless the context clearly indicates otherwise. For example, reference to a component in the singular is intended to comprise a plurality of components.

Throughout this application, where publications are referenced, the disclosures of these publications in their entireties are hereby incorporated by reference into this application to more fully describe the state of the art to which this invention pertains.

The following terms or phrases used herein have the exemplary meanings listed below in connection with at least one embodiment:

"Alloy steel" means steel containing specified quantities of alloying elements (other than carbon and manganese) added to effect changes in properties of the base material.

"Alloy system" means a complete series of compositions produced by mixing in many proportions any group of two or more components, at least one of which is a metal.

"Austenite" means a structure or phase found in iron alloys. It is a solid solution of one or more elements in face-centered cubic iron (gamma iron).

"Austenitic steel" an alloy steel whose structure is normally austenitic at room temperature.

"BCC" means body centered cubic. Atoms are arranged at the corners of the cube with another atom at the cube center. Close Packed Plane cuts the unit cube in half diagonally. Two atoms in one unit cell.

"Brittle" means permitting little or no plastic (permanent) deformation prior to fracture.

"Brittleness" means the tendency of a material to fracture without first undergoing significant plastic deformation.

"Brinell hardness number" means a number related to the applied load and to the surface area of the permanent impression made by a ball indenter.

"Brinnel hardness test" means a test for determining the hardness of a material by forcing a hard steel or carbide ball of specified diameter (typically, 10 mm, or 0.4 inches) into it under a specified load. The result is expressed as the Brinell hardness number.

"Ductility" means the ability of a material to deform plastically without fracturing.

"Coefficient of Friction" means a number which represents the friction between two surfaces. Between two equal surfaces, the coefficient of friction will be the same. The symbol usually used for the coefficient of friction is g. The maximum frictional force (when a body is sliding or is in limiting equilibrium) is equal to the coefficient of friction× the normal reaction force. $F=\mu R$, where $\mu$ is the coefficient of friction and R is the normal reaction force. This frictional force, F, will act parallel to the surfaces in contact and in a direction to oppose the motion that is taking or trying to take place.

"Coefficient of thermal expansion" means a solid expansion in response to expansion on heating and contraction on cooling. Different substances expand by different amounts. Over small temperature ranges, the thermal expansion of uniform linear objects is proportional to temperature change. This response to temperature change is expressed as its coefficient of thermal expansion. In reference to "linear thermal expansion", when an object is heated or cooled, its length changes by an amount proportional to the original length and the change in temperature. Where coefficient of linear thermal expansion is represented by $\alpha$, $\alpha$ in $10^{-6}$/K at 20° C.

"Corrosion" means the chemical or electrochemical reaction between a material, usually a metal, and its environment that produces a deterioration of the material and its properties.

"Crystalline" means that form of a substance that is predominantly comprised of crystal, as opposed to glassy or amorphous.

"Crystal" means a three-dimensional atomic, ionic, or molecular structures consisting of one specific orderly geometrical array, periodically repeated and termed lattice or unit cell.

"Deposition" means the process of applying a sprayed material to a substrate.

"Deposition rate" means the weight of material deposited in a unit of time. It is usually expressed as kilograms per hour (kg/h) or pounds per hour (lb/h).

"FCC" means face centered cubic. Atoms are arranged at the corners and center of each cube face of the cell. Close packed Plane: On each face of the cube. Atoms are assumed to touch along face diagonals. Four atoms in one unit cell. $a=2R\sqrt{2}$ "Friction" means the resisting force tangential to the common boundary between two bodies when, under the action of an external force, one body moves or tends to move relative to the surface of the other.

"Galvanic corrosion" means corrosion associated with the current of a galvanic cell consisting of two dissimilar conductors in an electrolyte or two similar conductors in dissimilar electrolytes.

"Hardness" means a measure of the resistance of a material to a surface indentation or abrasion. Indentation hardness can be measured by Brinell, Rockeweel, Vickers, Knoop, and Scleroscope hardness tests.

"Twinning" means a deformation process in crystals defined as the collective shearing of one portion of the crystal with respect to the rest.

"Vickers hardness number" means a number related to the applied load and the surface area of the permanent impression made by a diamond indenter having included face angles of 136°.

"Vickers hardness test" means a microindentation hardness test employing a 136 diamond pyramid indenter (Vickers) and variable loads. Also known as diamond pyramid hardness test. Thermal spraying may incrementally and selectively deposit material in thin, two-dimensional layers. Shape deposition can be done in many ways. Thermal spray methods (i.e. plasma, electric arc, or combustion) are used to deposit thin, planar layers of material. Each of these layers is carefully shaped using disposable, laser generated masks. The artifact being produced is grown as a succession of thermally sprayed, cross-sectional layers within a sacrificial support structure.

The use of spray technologies can be used to deposit metallic, ceramic, and polymeric coatings to provide enhanced wear, friction, corrosion, and/or lubrication properties in lightweight applications. However, the current thermal spray alloys all have signification limitations in terms of the physical and mechanical properties they possess. Therefore, a need exists to develop a thermally-sprayable steel-based alloy that can provide the wear, friction, corrosion, and/or lubrication properties of traditional materials in a lightweight substrate material.

Thermal spray is a generic term for a group of coating processes used to apply metallic or nonmetallic coatings. These processes may be grouped into three major categories: flame spray, electric arc spray, and plasma arc spray. These energy sources are used to heat the coating material (in powder, wire, or rod form) to a molten or semimolten state. The resultant heated particles are accelerated and propelled toward a prepared surface by either process gases or atomization jets. Upon impact, a bond forms with the surface, with subsequent particles causing thickness buildup and forming a lamellar structure. The thin "splats" undergo very high cooling rates, typically in excess of $10^6$ K/s for metals.

Industries use thermal spray coatings because they offer improved: wear resistance; heat resistance (thermal barrier coatings); dimensional control; corrosion and/or oxidation resistance; and/or, electrical properties (resistance and conductivity).

The term "thermal spray" describes a family of processes that include thermal spray and cold spray. Thermal spray uses the thermal energy generated by chemical (combustion) or electrical (plasma or arc) methods to melt, or soften, and accelerate fine dispersions of particles or droplets to speeds in the range of 50 to >1000 m/s (165 to >3300 ft/s). The high particle temperatures and speeds achieved result in significant droplet deformation on impact at a surface, producing thin layers or lamellae, often called "splats," that conform and adhere to the substrate surface. Solidified droplets build up rapidly, particle by particle, as a continuous stream of droplets impact to form continuous rapidly solidified layers. Individual splats are generally thin (~1 to 20 μm), and each droplet cools at very high rates (>$10^6$ K/s for metals) to form uniform, very fine-grained, polycrystalline coatings or deposits. In contrast to thermal spray, the feed stock using cold spray technology is either not heated or is heated only enough to plastically soften the particles. High pressure gas is used to accelerate powder particles to high velocities to subsequently be impacted on the substrate. The energy associated with the impact event causes a high degree of plastic deformation that bonds the particle to the substrate, and thus builds up a layered structure.

Thermal spray coatings may contain varying levels of porosity, depending on the spray process, particle speed and size distribution, and spray distance. Porosity may be beneficial in applications through retention of lubricating oil films. Porosity also is beneficial in coatings on biomedical implants. The porosity of thermal spray coatings is typically <5% by volume. The retention of some unmelted and/or re-solidified particles can lead to lower deposit cohesive strengths, especially in the case of "as-sprayed" materials with no post deposition heat treatment or fusion. Other key features of thermal spray deposits are their generally very fine grain structures and columnar orientation. Thermal-sprayed metals, for example, have reported grain sizes of <1 μm prior to post deposition heat treatment. Grain structure across an individual splat normally ranges from 10 to 50 μm, with typical grain diameters of 0.25 to 0.5 μm, owing to the high cooling rates achieved (~$10^6$ K/s).

Benefits of thermal spraying compared to other coating processes are many. Reduced cost is one benefit. The cost of repairing the component is less than buying a new one. Often, the coating actually lasts longer than the original material used. Another benefit is low heat input. With few exceptions, the thermal spray process leaves the component's thermal history alone. Another benefit is versatility. Almost any metal, ceramic or plastic can be thermal sprayed. Thickness range is another benefit. Depending on the material and spray system, coatings can be sprayed from 0.001 to more than 1 inch thick. The thickness typically ranges from 0.005-0.1 inch. Processing speed is another benefit. The spray rates range from 3-60 lb/hr depending on the material and the spray system. Typical rates for material application are ½-2 lb of material per sq ft per 0.01 inch thickness.

Versatility with respect to the coating material, which can be metal, cermet, ceramic and polymer, in the form of powder, rod or wire. There is a comprehensive choice of coating materials to meet the needs of a wide variety of applications, in particular protection from wear and corrosion damage. Coatings of metal, cermet, ceramic and plastic can be applied to any substrate that will not degrade from the heat of the impinging particles or gas jets. The coating is formed with minimal heating of the substrate and the coating does not need to fuse with the substrate to form a bond. Substrate temperature seldom exceeds 300° C. As a consequence, coatings can be applied to components with little or no pre- or post-heat treatment and component distortion is minimal. The coatings can also be applied to thermal sensitive substrates such as low melting point metals and plastics. Thick coatings, typically up to 10 mm, can be applied and often at high deposition rates. This means that thermal spraying can also be used for component reclamation and spray forming. Parts can be rebuilt quickly and at low cost, usually at a fraction of the replacement price.

Thermal spraying has the capacity to form barrier and functional coatings on a wide range of substrates.

The following reference is incorporated in its entirety: "Handbook of Thermal Spray Technology", J. R. Davis (Oct. 30, 2004), ISBN-10: 0871707950.

A new metal alloy composition is desired that will have the requisite wear, friction, corrosion, and/or lubrication properties in addition to the metal alloy composition being capable of thermally-sprayed and/or cold-sprayed. However, the current thermal spray alloys all have signification limitations in terms of the physical and mechanical properties they possess. Typical steel alloys are not engineered to have a synergy between the alloy and the supporting substrate. The prior art is concerned with making an alloy into a rod form or a cast form. Thus, the prior art does not approach a feed stock than can be sprayed and alloy which matches the coefficient of thermal expansion with the substrate.

In view of the above-described problems, in one embodiment of the present invention relates to a composite ferrous-based metal alloy with specific additions of manganese and the alloy composite having desirable resistance to wear and galvanic corrosion as well as having a similar coefficient of friction and thermal expansion coefficient. An object of another embodiment of the present invention is to provide a lightweight composite metal alloy that is provides enhanced wear, friction, corrosion, and lubrication properties in lightweight applications. In yet another embodiment of the present invention is to provide a lightweight metal alloy composition suitable for thermal spray application.

With reference to FIG. 1, a composite metal alloy material comprises base layer and a thermal spray alloy layer. The base layer, or in the alternative, is a substrate support. Suitable base layer includes a metal alloy, such as, but not limited to: alloys of aluminum, alloys of bismuth, alloys of chromium, alloys of cobalt, alloys of copper, alloys of gallium, alloys of gold, alloys of indium, alloys of iron, alloys of lead, alloys of magnesium, alloys of mercury, alloys of nickel, alloys of potassium, alloys of plutonium, rare earth alloys, alloys of rhodium, alloys of scandium, alloys of silver, alloys of sodium, alloys of titanium, alloys of tin, alloys of uranium, alloys of zinc, alloys of zirconium, and combinations thereof. It should be appreciated that the base layer may be any suitable material which may support a thermal spray layer, including but not limited to: wood, paper, glass, ceramic, cloth and the like. In one embodiment, the base layer is an aluminum alloy layer having 80 to 100% Al by weight.

In the field of thermal spray alloys, the use of iron-manganese is not common. Conventional wisdom to add manganese was only for the sole reason of hardness. In these applications which utilize manganese, typically 15% manganese or less is present since the requisite high hardness is achieved for the desired application. Thus, the benefit is achieved at 15% or less to have the requisite hardness. In at least one embodiment, a thermal spray alloy is provided having manganese exceeding 15%. The increase in manganese is not solely for hardness and wear resistance, additional manganese allows matching the coefficient of thermal expansion with other elements. In one embodiment, the thermal spray alloy surface comprises, by weight, 20% to 40% manganese and 47% to 76% iron by weight in overlaying contact with the aluminum alloy layer.

To provide favorable characteristics of wear, friction, corrosion, and/or lubrication properties, a synergy between the aluminum alloy layer, the substrate, and the thermal spray alloy layer of manganese and iron was investigated. Materials with anisotropic structures, such as crystals (with less than cubic symmetry) will generally have different linear thermal expansion coefficients, $\alpha_L$, in different directions. $\alpha L=1/L\ dL/dt$, where L is a particular length measurement and dL/dT is the rate of change of that linear dimension per unit change in temperature. As a result, the total volumetric expansion is distributed unequally among the three axes. If the crystal symmetry is monoclinic or triclinic, even the angles between these axes are subject to thermal changes. In such cases it is necessary to treat the coefficient of thermal expansion as a tensor with up to six independent elements. The dimensional change of aluminum and its alloys with a change of temperature is roughly twice that of the ferrous metals. The average coefficient of thermal expansion for commercially pure metal is $24\times10^{-6}$/K ($13\times10^{6}$/° F.). Matching the coefficient of thermal expansion of the thermal spray alloy layer with the aluminum alloy layer reduces the galvanic corrosion potential of the thermal spray alloy layer with the aluminum alloy layer. In one embodiment, the aluminum alloy layer and the thermal spray layer have a coefficient of thermal expansion within a range of 20 to 300° C. In one embodiment, the coefficient of thermal expansion is optimized to match the aluminum alloy layer having a range between 20-24/° C. (11.1-13.4/° F.) per degree centigrade. In another embodiment, the coefficient of thermal expansion of the aluminum alloy layer and the thermal spray layer differ less than 40° C. In other refinement, the range of coefficient of thermal expansion between the thermal spray layer and the aluminum alloy layer is less than or equal to in increasing order of preference, 20 to 300° C., 20 to 200° C., 20 to 100° C., 20 to 50° C., and 20 to 30° C. In another refinement, the coefficient of thermal expansion of the aluminum alloy layer and the thermal spray layer differ less than or equal to in increasing order of preference, 40° C., 30° C., 20° C., 10° C., 5° C., 3° C., 1° C., and 0° C. With respect to a steel substrate to match the coefficient of thermal expansion, the coefficient of thermal expansion will be approximately 15, or in the range of 14-18.5. In the alternative, the coefficient of thermal expansion of steel may be increased to 20-24/° C. by changing the phase of the material.

Aluminum alloys are affected by the presence of silicon and copper, which reduce expansion, and magnesium, which increases it.

The thermal spray alloy layer and the aluminum alloy layer each have a temperature range. Defining operability as the temperature below which the alloy remains solid and capable of providing needed mechanical properties for the specific application. For example a specific application is a braking surface on the rotor. For a thermal spray allow layer of 20 to 40% Mn and 47 to 76% Fe, the temperature range is at least −60 to +1250° C. However, the maximum temperature of the system having a thermal spray allow layer and a substrate may depend on the substrate material. As a non-limiting example, Al for a substrate, then the system should not exceed approximately 500° C. since Al may begin to melt; carbon fiber as a substrate may require a lower temperature because the temperature at approximately 500° C. would attack the carbon fiber materials before it would attack the thermal spray. In a refinement, the thermal spray alloy alone is capable of sustained operations for an infinite number of hours at 400° C., 500° C., 600° C., 700° C., and 800° C.

Figure 4:
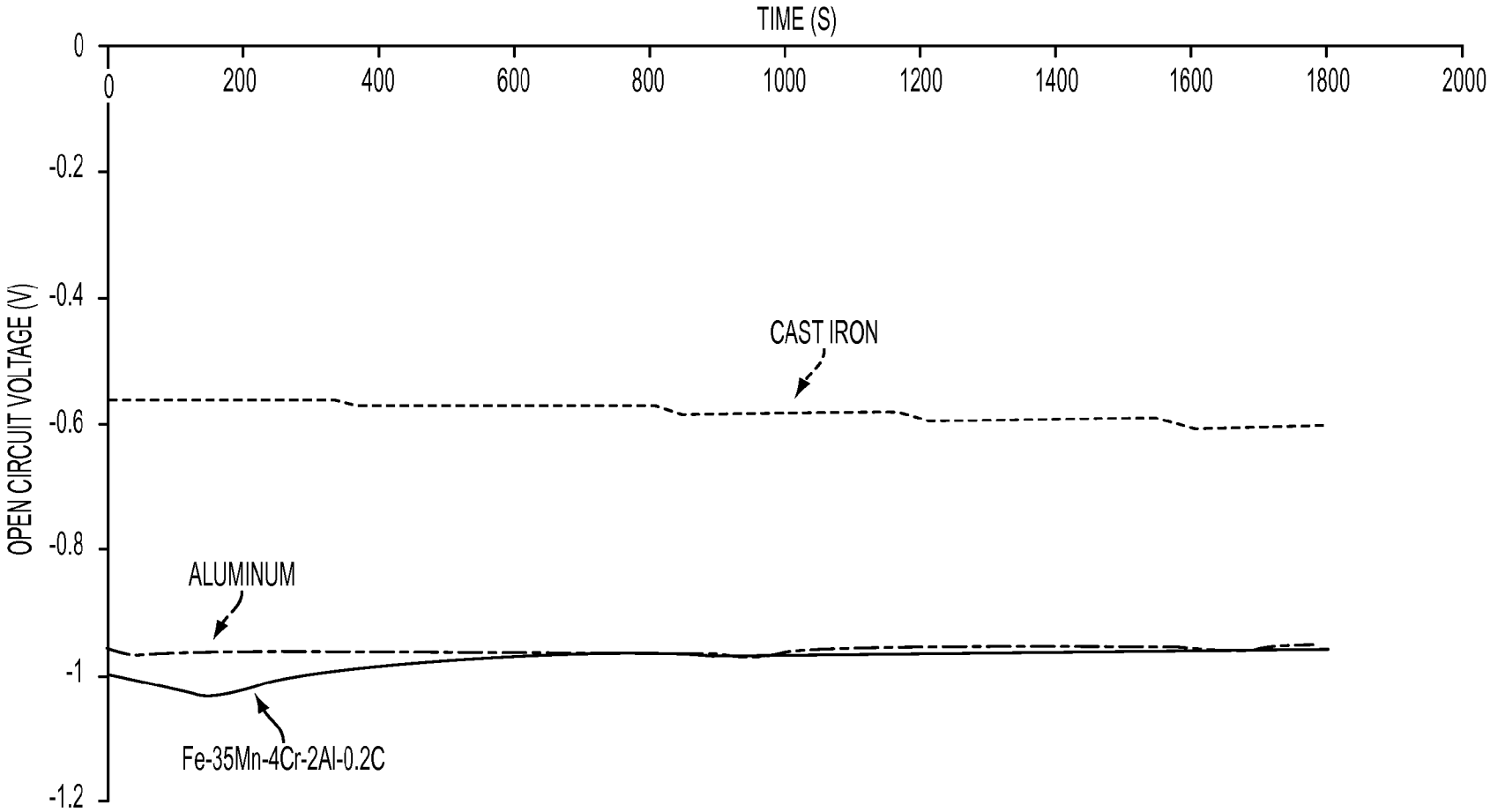
FIG. 4 is a graph demonstrating the effect of material on the open potential circuit voltage.

Galvanic corrosion may contribute to accelerated corrosion. Dissimilar metals and alloys have different electrode potentials, and when two or more come into contact in an electrolyte, one metal acts as anode and the other as cathode. Galvanic corrosion is that part of the corrosion that occurs at the anodic member of such a couple and is directly related to the galvanic current by Faraday's law. The electropotential difference between the dissimilar metals is the driving force for an accelerated attack on the anode member of the galvanic couple. The anode metal dissolves into the electrolyte, and deposit collects on the cathodic metal. The electrolyte provides a means for ion migration whereby metallic ions move from the anode to the cathode within the metal. This leads to the metal at the anode corroding more quickly than it otherwise would and corrosion at the cathode being inhibited. The presence of an electrolyte and an electrical conducting path between the metals is essential for galvanic corrosion to occur. The addition of chromium and aluminum impart better galvanic corrosion resistance. In another embodiment referring to FIG. 4, the thermal spray alloy layer when coupled to a low-copper cast aluminum alloy will have a voltage difference no greater than 0.075 V when a galvanic cell is created. FIG. 4 shows that the galvanic potential associated with having two materials in contact with each other in the presence of an electrolyte. The closer the two lines, the less of a chance there is to corrode. Therefore, because the difference between the thermal spray alloy and aluminum is small, there is a low degree of corrosion associated with using these two materials together.

To further improve the corrosion resistance of the thermal spray layer, the thermal spray layer is nearly or 100% austenitic through its whole temperature range. In another embodiment, the thermal spray alloy layer has at least 30% Mn. The thermal spray alloy layer with approximately less than 30% Mn may not remain 100% austenitic throughout the entire temperature range. As the % of Mn decreases below approximately 30% of the thermal spray alloy layer, the upper temperature range of the thermal spray layer will accordingly decrease. In another embodiment, the thermal spray alloy layer is essentially 100% face-centered cubic, FCC, crystal lattice structure within the temperature range. The additions of Mn to exceed approximately 30% leads to the formation of the stable austenitic microstructure. In yet another embodiment, the thermal spray alloy layer is essentially free of body-centered cubic, BCC, crystal lattice structure within the temperature range.

The friction and wear properties of magnesium alloys are important especially when they are being used in critical industrial applications. While magnesium alloys normally cannot be candidates for bearings or gears, there are situations in which the metal surface may come into contact with other materials so as to make the friction and wear behaviors of magnesium alloys the topic of interest. For example, magnesium alloys are subjected to sliding motion in automotive brakes, engine piston and cylinder bores. In addition, the friction and wear performances of magnesium alloys are the important consideration during their processing by rolling, extrusion, forging, etc. The friction and wear of magnesium alloys may normally be reduced by using a lubricant coupled with appropriate anti-wear and friction-reducing additives known in the art. To further improve the coefficient of friction, the thermal spray alloy layer temperature range is increased to resist melting which results in the coefficient of friction decreasing. In another embodiment, the thermal spray alloy has a coefficient of friction in the range of 0.3 to 0.4.

Figure 2:
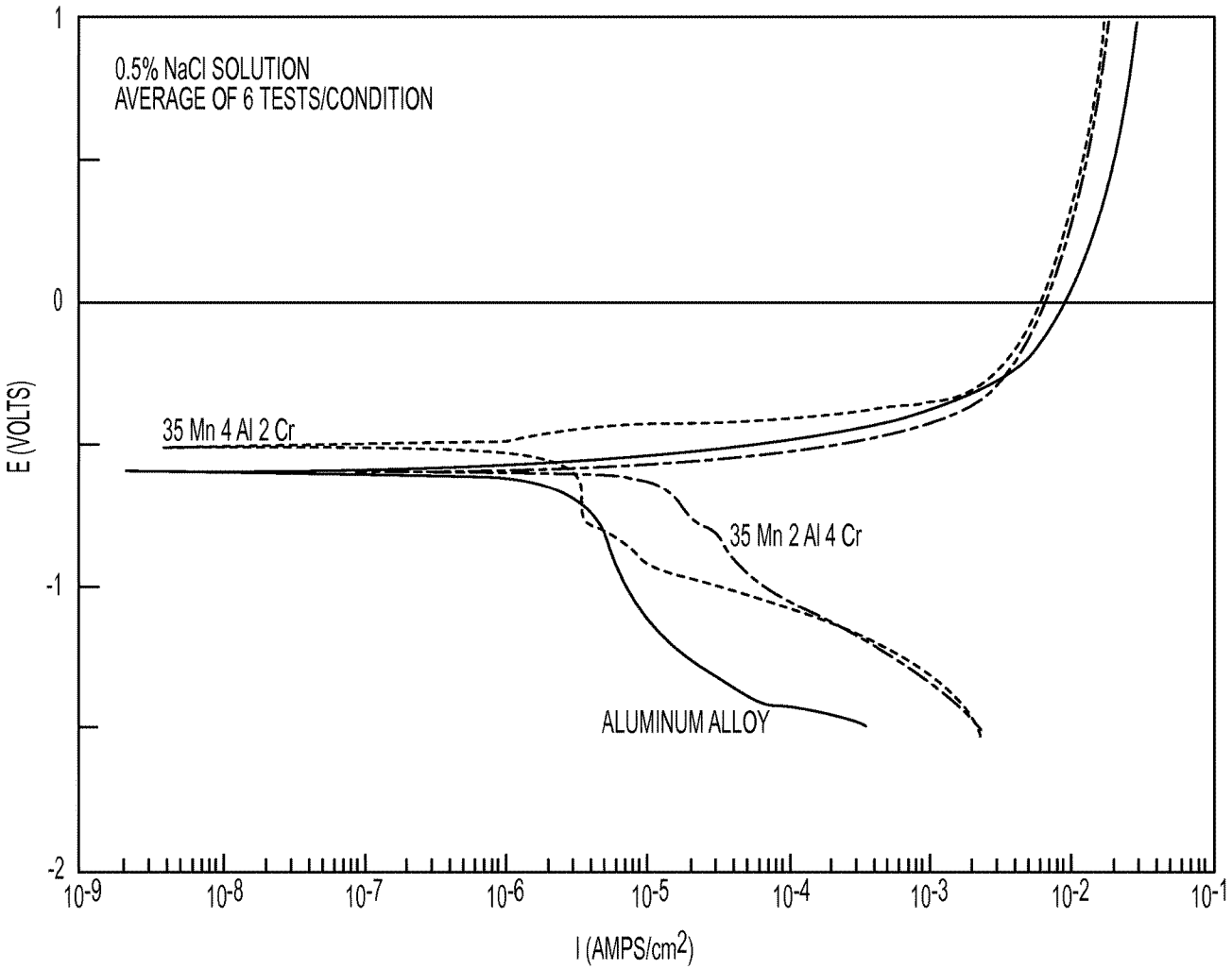
FIG. 2 is a graph demonstrating the effect of alloy content on the galvanic corrosion potential in the high-manganese ferrous alloy.
Figure 3:
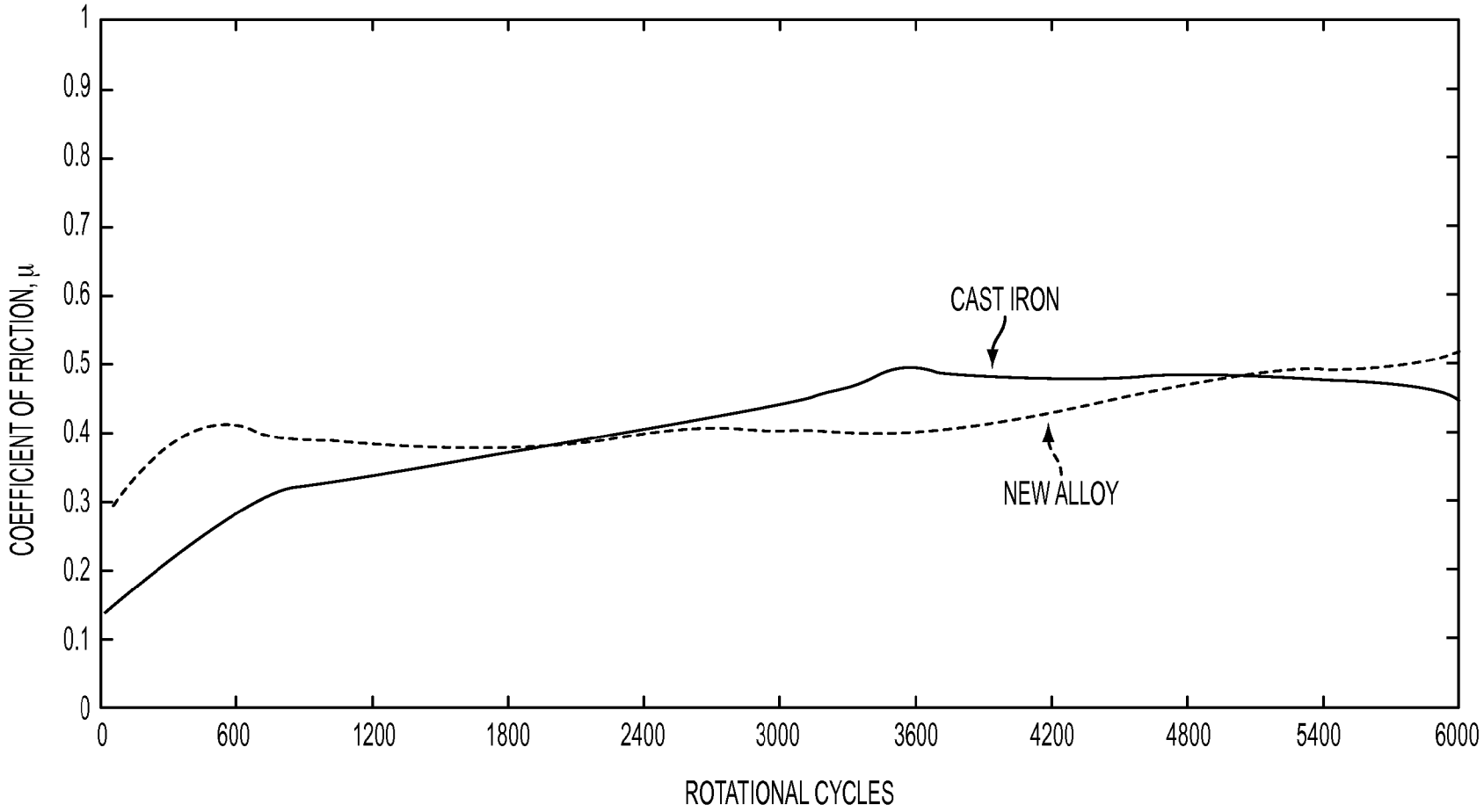
FIG. 3 is a graph demonstrating the frictional characteristics of the high-manganese ferrous alloy.

To increase the performance of the thermal spray alloy, the thermal spray alloy layer in addition to 20 to 40% Mn and 47 to 76% Fe by weight may comprise at least one component of 3 to 5% chromium (Cr), 1 to 6% aluminum (Al), 0 to 2% carbon (C), and the combinations thereof. Referring to FIGS. 2 and 3 thermal spray alloy having Fe, Mn, Cr, Al, and/or carbon as compared to traditional cast iron, offers comparable resistance to wear and galvanic corrosion (see FIG. 2) as well as having a similar coefficient of friction (see FIG. 3). The addition of Cr and/or Al provides better galvanic corrosion resistance of the thermal spray alloy. Moreover, the additional elements of Cr, Al, and/or C provide an optimum thermal conductivity to dissipate heat. The addition of carbon is for imparting better high temperature complexing. In yet another embodiment to limit galvanic corrosion, corrosion inhibitors such as sodium nitrite or sodium molybdate can be intermixed with the alloys. These inhibitors may be intermixed to an amount equal to or less than 30% by weight.

To aid in increased hardness of the thermal spray alloy, manganese of hexagonal lattice structure is chosen. Twinning results in a high value of the instantaneous hardening rate (n value) while the microstructure turns out to be finer and finer. The resultant twin boundaries behave like grain boundaries, thus reinforcing the alloy. In another embodiment, the manganese content is equal to or greater than 15% by weight, and in one variation 17% to 24% by weight. These levels are chosen to induce twinning, which makes the alloy completely austenitic at room temperatures.

When a substance is heated, its particles begin moving more and thus usually maintain a greater average separation. Thermal expansion is the tendency of matter to change in volume in response to a change in temperature. The degree of expansion divided by the change in temperature is called the material's coefficient of thermal expansion. Increasing the manganese to exceed 15% by weight, and in another variation 20% to 40% by weight matches the coefficient of thermal expansion with the aluminum.

The wear resistance and hardness of the alloys may behave differently at room temperature as compared to "high temperatures", such as exceeding 300° C. The effects of chemical composition on the high-temperature properties of alloys are important for optimizing alloy composition for high-temperature applications. Hardness is considered as an important material property for alloys because it is often used to correlate to wear resistance of materials. The wear resistance of alloys at room temperature mainly depends on their carbon content. The elements manganese with iron imparts high temperature (exceeding 300° C.) hardness. Yet to stabilize the alloys, carbon may be added to stabilize the alloys at room temperature and temperatures below 200° C. The carbon content effect on the wear resistance of alloys is not as significant at elevated temperatures as at room temperature, thus, to impart greater alloy stability at temperatures above 200° C. increase of chromium content enhances the high-temperature oxidation resistance. In another embodiment, the thermal spray alloy comprises 0% to 2% carbon by weight. If using the alloy in a low temperature situation, it is possible to have an alloy composition devoid of carbon or less than 0.5%.

Figure 5:
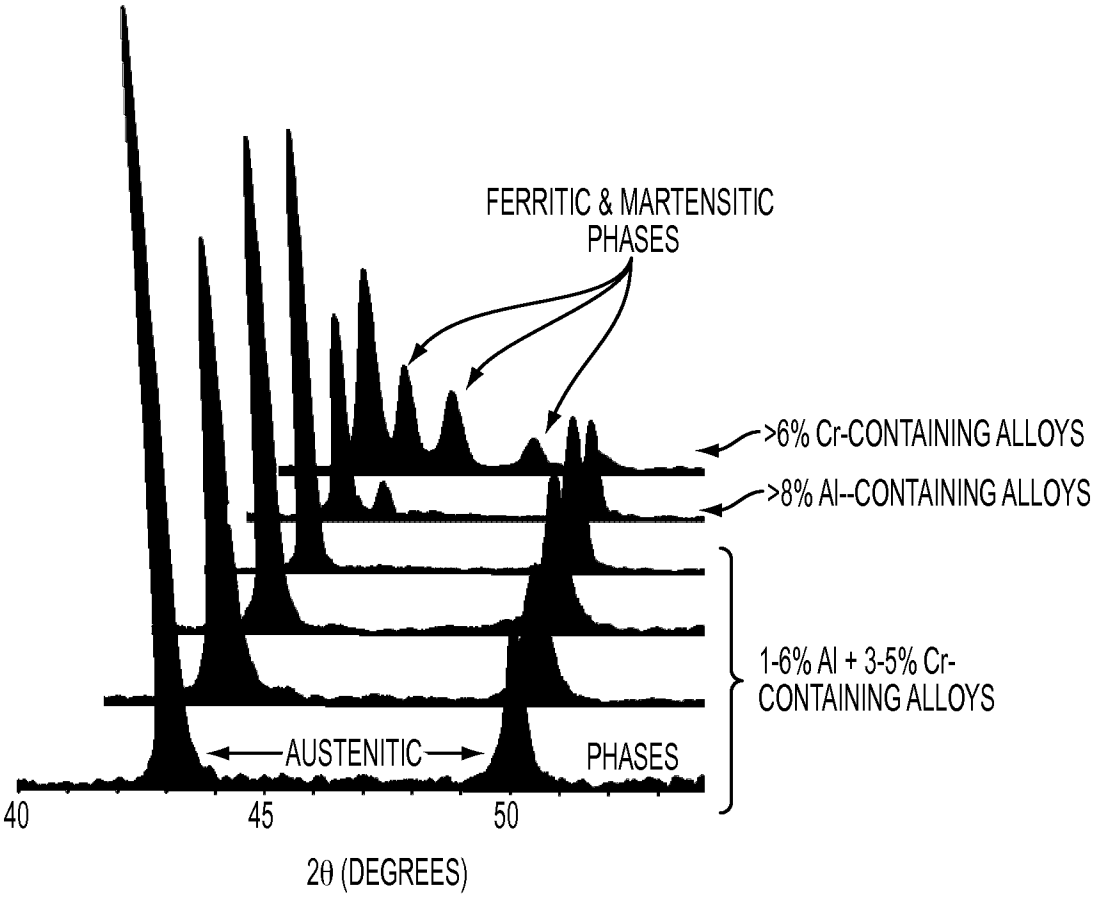
FIG. 5 is a graph demonstrating the effect of alloy content on phase stability in the high-manganese ferrous alloy.

Referring to FIG. 5 shows the effect of alloy elements on the phase development in the Fe/30-40% Mn/0.1-0.3% C Ferrous Alloy. FIG. 5 establishes that when the chemical composition is outside the limits established by a composition outside the parameters of 20 to 40% Mn, 47 to 76% Fe, or the addition of at least one component from 3 to 5% Cr, 1 to 6% Al, and 0 to 2% carbon by weight, the microstructure will no longer be 100% austenitic. For example, alloys containing 6% Cr by weight, outside the 3 to 5% Cr, have ferritic and martensitic phases as shown by intermediate peeks between the austenitic phases, see FIG. 5. Moreover, alloys containing 8% Cr by weight, outside the 1 to 6% Al, have ferritic and martensitic phases. In another embodiment, the thermal spray alloy is essentially free of ferritic and/or martensitic phases. Therefore, the presence of ferritic and/or martensitic phases negates a large number of the beneficial properties (reduced corrosion potential, matched coefficient of thermal expansion, and material stability through a large temperature range), and the resultant alloy will not be effective for a high wear, stable friction application like a brake rotor.

Hardness of an alloy may be a desirable characteristic in that the alloy's ability to resists plastic deformation or abrasion. In one embodiment, the thermal spray alloy layer has a hardness of 168 to 368 measured using the 500 g Vickers Microhardness Scale.

The ASTM C633 test method is used to determine the adhesion or cohesion strength of a thermal spray by subjecting it to tension perpendicular to the surface (ASTM International, 100 Barr Harbor Drive, PO Box C700, West Conshohocken, Pa., 19428-2959 USA). In one embodiment the thermal spray alloy layer and the aluminum alloy layer or base layer, has a mechanical compatibility to each other of 20 to 60 MPa as determined using ASTM C633 test.

The thermal spray alloy may be in the form of blended elemental powders, pre-alloyed powder, and/or melted and cast into a desired shape such as wire or rod.

Generally with thermal spray process, surface preparation may be required of the base layer in order to provide satisfactory adhesion of the thermal spray alloy layer. There is mechanical compatibility between the base structure and the thermal spray alloy. Mechanical compatibility is typically obtained through the use of standard surface preparation techniques such as grit blasting or the machining of a geometrical groove (such as a square wave pattern.) Roughen, for example, is carried out on base layers made from materials having a hardness of less than about 300 DPN, by mechanical means such as, for example, by grit-blasting or by rough-machining techniques. However, such roughening treatment may be ineffective on substrate materials having hardness greater than 300 DPN and it may be then necessary to apply an intermediate bond coat to the substrate upon which bond-coat the metal or ceramic coating may be thermally sprayed. In the alternative, sometimes the very act of laying down the thermal spray alloy layer will create a certain level of residual stress in the base layer to aid in thermal spray alloy layer attachment. In yet another alternative, annealing is an optional treatment. Further yet in another embodiment, if the geometry of the base layer is simple enough and the thermal spray alloy powder is thin enough, then an annealing step may not be necessary.

A thermal spray alloy having Mn substituted for more expensive elements of nickel and chromium allows for the alloy cost to be reduced. Further, the ability of the thermal spray alloy to be thermally sprayed (using a wide variety of thermal, cold, and direct metal deposition processes) also will help minimize the cost of the process. Thus, the composition combination of the alloying additions Fe, Mn, Cr, Al, and C results in a thermally sprayable alloy that offers an incomparable combination of wear, friction, corrosion, and lubrication properties.

A method to apply the thermal spray alloy layer on a base layer includes providing and applying the thermal spray alloy through thermal spray, gas dynamic cold spray, plasma spraying, wire arc spraying, flame spraying, high velocity oxy-fuel coating spraying, and warm spraying directly to a base layer. Prior to applying the thermal spray alloy layer, the base layer may be surface prepared to aid in thermal spray alloy layer adhesion. The thermal spray alloy layer may be applied to the base layer in a thickness of up to 3 mm.

Examples

Table 1 provides several thermal spray alloy compositions and weight % determination.

| Element | Weight % of Element in Analysis Sample | | | |
|---|---|---|---|---|
| | #1 | #2 | #3 | #4 |
| Fe | 51.03 | 59.00 | 55.67 | 56.67 |
| Mn | 37.74 | 30.33 | 33.08 | 34.2 |
| Al | 5.87 | 4.98 | 5.63 | 5.12 |
| Cr | 4.68 | 4.97 | 4.41 | 3.71 |
| Si | 0.42 | 0.47 | 0.65 | 0.08 |
| C | 0.09 | 0.08 | 0.11 | 0.07 |
| S | 0.08 | 0.09 | 0.09 | 0.07 |
| Ni | 0.03 | 0.033 | 0.31 | 0.025 |
| Co | 0.02 | 0.018 | 0.015 | 0.017 |
| Mo | <0.01 | <0.01 | <0.01 | <0.01 |
| W | <0.01 | <0.01 | <0.01 | <0.01 |
| P | 0.009 | 0.006 | 0.011 | 0.008 |
| V | <0.008 | <0.008 | <0.008 | <0.008 |

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An alloy composite material comprising:

an aluminum alloy layer; and a thermal spray alloy layer of 30 to 40% Mn, 1 to 6% Al, 47 to 76% Fe and 3-5% Cr by weight selected to not exceed 100% by weight, being absent of a ferritic phase, and in overlaying contact with the aluminum alloy layer.

2. The alloy composite material of claim 1, wherein each of the aluminum alloy layer and the thermal spray alloy layer has a coefficient of thermal expansion equal to each other.

3. The alloy composite material of claim 2, wherein the coefficient of thermal expansion is in a range of 20 to $24\times10^{-6}/°$ C.

4. The alloy composite material of claim 1, wherein the aluminum alloy layer includes 80 to 100% Al by weight.

5. The alloy composite material of claim 1, wherein the thermal spray alloy layer has an austenitic phase.

6. The alloy composite material of claim 5, wherein the thermal spray alloy layer consists essentially of the austenitic phase.

7. The alloy composite material of claim 6, wherein the thermal spray alloy layer is essentially free of a martensitic phase.

8. The alloy composite material of claim 6, wherein thermal spray alloy layer is essentially free of BCC crystal lattice structures.

9. The alloy composite material of claim 6, wherein the thermal spray alloy layer consists essentially of FCC crystal lattice structures.

10. The alloy composite material of claim 1, wherein the thermal spray alloy layer having a hardness of 168 to 368 as measured using 500 g Vickers microhardness scale.

11. The alloy composite material of claim 1, wherein the thermal spray alloy layer having a galvanic corrosion potential of no greater than 0.075 V.

12. The alloy composite material of claim 1, wherein the thermal spray alloy layer having a coefficient of friction value between of 0.3 to 0.4.

13. An alloy composite material comprising:

an aluminum alloy layer; and a thermal spray alloy layer of 30 to 40% Mn and 47 to 70% Fe by weight being essentially free of a ferritic phase, and in overlaying contact with the aluminum alloy layer, wherein the aluminum alloy layer and the thermal spray alloy layer have a mechanical compatibility to each other of 20 to 60 MPa as determined using tests specified by ASTM C633 test.

14. An alloy composite material comprising:

an aluminum alloy layer; and a thermal spray alloy layer of 30 to 40% Mn, 1 to 6% Al, and 47 to 76% Fe and 3-5% Cr by weight selected to not exceed 100% by weight, being absent of a ferritic phase and substantially free of BCC crystal lattice structures, and in overlaying contact with the aluminum alloy layer.

15. The alloy composite material of claim 14, wherein the thermal spray alloy layer consists essentially of FCC crystal lattice structures.

16. The alloy composite material of claim 14, wherein the thermal spray alloy layer has a microstructure of 100% austenitic phase.

17. The alloy composite material of claim 13, wherein the thermal spray alloy layer has a microstructure of 100% austenitic phase.

18. The alloy composite material of claim 1, wherein the thermal spray alloy layer has a microstructure of 100% austenitic phase.

19. The alloy composite material of claim 13, wherein each of the aluminum alloy layer and the thermal spray alloy layer has a coefficient of thermal expansion equal to each other.

20. The alloy composite material of claim 19, wherein the coefficient of thermal expansion is in a range of 20 to $24\times10^{-6}/°$ C.

* * * * *